US011642909B2

(12) United States Patent
Yoshida et al.

(10) Patent No.: US 11,642,909 B2
(45) Date of Patent: May 9, 2023

(54) WRITING INSTRUMENT

(71) Applicant: KURETAKE CO., LTD., Nara (JP)

(72) Inventors: Katsuya Yoshida, Nara (JP); Shigeaki Kosaka, Nara (JP)

(73) Assignee: KURETAKE CO., LTD., Nara (JP)

( * ) Notice: Subject to any disclaimer, the term of this patent is extended or adjusted under 35 U.S.C. 154(b) by 0 days.

(21) Appl. No.: 17/825,199

(22) Filed: May 26, 2022

(65) Prior Publication Data

US 2022/0379651 A1 Dec. 1, 2022

(30) Foreign Application Priority Data

May 31, 2021 (JP) ..... JP2021-091605

(51) Int. Cl.
*B43K 5/08* (2006.01)
*B43K 5/18* (2006.01)

(52) U.S. Cl.
CPC ..... *B43K 5/08* (2013.01); *B43K 5/1827* (2013.01); *B43K 5/1836* (2013.01); *B43K 5/1863* (2013.01)

(58) Field of Classification Search
CPC ..... B43K 5/08; B43K 5/1827; B43K 5/1818; B43K 5/1836; B43K 5/1845; B43K 5/1854; B43K 5/1863
USPC ..... 401/205, 206, 261, 263, 270, 272
See application file for complete search history.

(56) References Cited

FOREIGN PATENT DOCUMENTS

JP 2019209531 A 12/2019

*Primary Examiner* — David J Walczak
(74) *Attorney, Agent, or Firm* — The Webb Law Firm

(57) ABSTRACT

Provided is a writing instrument which includes a pen tip part; a coating liquid storage section; a cylindrical part so as to cover the coating liquid storage section, and fixed to the pen tip part; a valve mechanism disposed at a tip end portion of the coating liquid storage section; an operation member configured to open the valve mechanism and allow the coating liquid flowing out from the coating liquid storage section to flow toward a pen tip side via the valve mechanism; and a cylindrical elastic member connecting the valve mechanism with the operation member. The coating liquid storage section is relatively movable to the pen tip part in the axial direction, and the operation member is configured to open the valve mechanism in association with the relative movement of the coating liquid storage section to the pen tip part.

4 Claims, 10 Drawing Sheets

WRITING INSTRUMENT

CROSS-REFERENCE TO RELATED APPLICATION

This application claims priority to Japanese Patent Application No. 2021-091605, the disclosure of which is hereby incorporated by reference in its entirety.

BACKGROUND OF THE INVENTION

Field of the Invention

The present invention relates to a writing instrument.

Description of Related Art

Conventionally, a water brush filled inside with water has been known. The water brush is used at the time of exercise of calligraphy or at the time of painting in watercolors at a place, for example, out of doors.

For example, JP 2019-209531 A describes a water brush including a brush tip part for applying water and a shaft part extending from the brush tip part, the shaft part including a coating liquid storage section for storing water. In the water brush described above, the coating liquid storage section includes a water through hole disposed at a tip end portion and a valve mechanism disposed at a rear end portion, and further includes an operation part for switching the valve mechanism between open state and close state. That is, according to such a water brush, a user presses the operation part to thereby cause the valve mechanism to come into open state so that the coating liquid storage section communicates with the external environment. Thus, water flows out from the water through hole to be supplied to the brush tip part. As seen from the above, the writing instrument of this type is demanded to supply an appropriate amount of water to the brush tip part at a timing intended by the user. This demand is required not only in the writing instrument including water but also in the writing instrument including ink.

However, the writing instrument described in JP 2019-209531 A is difficult to enable appropriate control of the supply amount of coating liquid such as water or ink only by means of operation of the operation part since the brush tip part and the coating liquid storage section are in constant communication with each other via the water through hole. Particularly in the case where the coating liquid has a low viscosity or low surface tension, the coating liquid may flow out from the water through hole even when the valve mechanism is in close state. Therefore, it is difficult to precisely control the supply amount of the coating liquid to the brush tip part.

Further, when the coating liquid is supplied to the brush tip part, it is necessary to prevent leakage of the coating liquid from any part other than the brush tip part. The water brush of JP 2019-209531 A, in which the valve mechanism and the operation part for opening the valve of the valve mechanism are arranged at the rear end portion, is provided with no measures to prevent leakage of the coating liquid from such a part.

SUMMARY OF THE INVENTION

In view of the aforementioned circumstances, it is an object of the present invention to provide a writing instrument that can more precisely control the supply amount of the coating liquid to the pen tip part, while preventing leakage of the coating liquid.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The writing instrument as an embodiment of the present invention includes: a pen tip part for applying a coating liquid; a coating liquid storage section for storage of the coating liquid; a cylindrical part having a cylindrical shape so as to cover the coating liquid storage section, and fixed to the pen tip part; a valve mechanism disposed at a tip end portion of the coating liquid storage section; an operation member fixed to the pen tip part and configured to open the valve mechanism and allow the coating liquid flowing out from the coating liquid storage section to flow toward a pen tip side via the valve mechanism; and a cylindrical elastic member being capable of expanding and contracting in an axial direction, and connecting the valve mechanism with the operation member to define a flow channel of the coating liquid between the valve mechanism and the operation member; in which the coating liquid storage section is relatively movable to the pen tip part in the axial direction, and the operation member is configured to open the valve mechanism in association with the relative movement of the coating liquid storage section to the pen tip part.

In the writing instrument, the operation member is preferably configured to bring the valve mechanism into open state by pressing the valve mechanism.

In the writing instrument, an end portion on one side of the cylindrical elastic member preferably covers the tip end portion of the coating liquid storage section, while covering the valve mechanism.

BRIEF DESCRIPTION OF THE DRAWINGS

The foregoing and other features of the present invention will become apparent from the following description and drawings of an illustrative embodiment of the invention in which.

DESCRIPTION OF THE INVENTION

Hereinafter, a writing instrument according to an embodiment of the present invention will be described with reference to the attached drawings.

A writing instrument 1 according to this embodiment is filled with ink as a coating liquid. Further, the writing instrument 1 is configured to be refillable with ink when ink has been exhausted.

Figure 1:
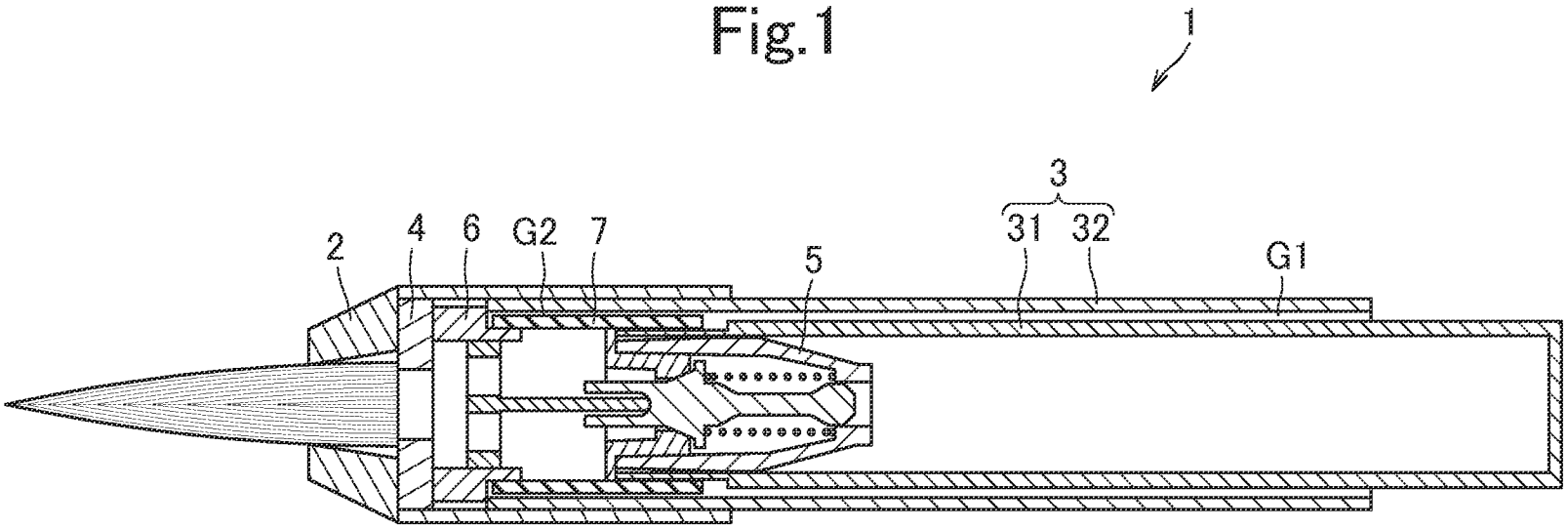
FIG. 1 schematically shows an internal structure of a writing instrument according to an embodiment.
Figure 2:
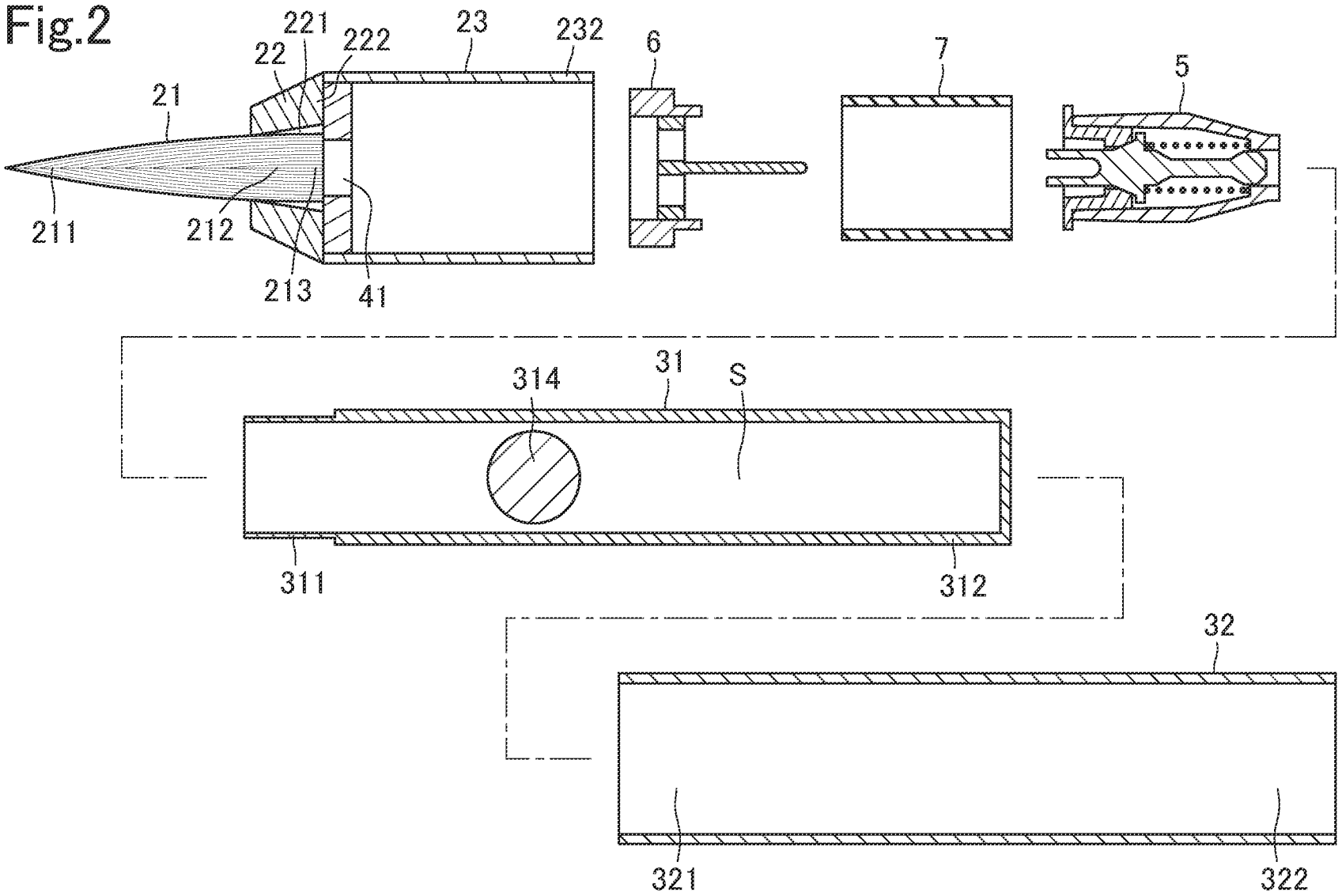
FIG. 2 is an exploded view of the writing instrument of FIG. 1.

As shown in FIG. 1 and FIG. 2, the writing instrument 1 according to this embodiment includes a pen tip part 2 for applying a coating liquid to an application target such as paper, and a shaft part 3 extending from the pen tip part 2. The shaft part 3 includes a coating liquid storage section 31 for storage of the coating liquid, and a cylindrical part 32 having a cylindrical shape so as to cover the coating liquid storage section 31.

In the description herein, a direction in which the writing instrument 1 extends is sometimes referred to as an axial direction, a direction orthogonal to the axial direction is sometimes referred to as a radial direction, and a direction rotating around a central axis of the writing instrument 1 is referred to as a circumferential direction. Also, a pen tip side in the axial direction is sometimes referred to as a tip end side, and the opposite side to the tip end side is referred to as a rear side.

In this embodiment, the pen tip part 2 includes an application part 21 configured to come into direct contact with an application target to apply the coating liquid to the application target, a retainer part 22 that retains the application part 21, and a hollow part 23 having a cylindrical shape and extending from the retainer part 22 toward the rear end.

The application part 21 is formed by a hair bundle of a plurality of hairs with one end portion bound with adhesive. That is, the application part 21 has a bundled part with one end portion of the plurality of hairs bound with adhesive, and a non-bundled part in which the plurality of hairs are not bound with adhesive. The bundled part is disposed on the rear end side of the application part 21, and the non-bundled part is disposed on the tip end side. A flow channel extending along the axial direction is formed in the bundled part. The coating liquid is supplied to the tip end portion 211 of the application part 21 via the flow channel. Specifically, the pen tip part 2 including the application part 21 is a brush tip part 2.

Further, the application part 21 is formed to decrease in diameter from a rear end portion 212 toward the tip end portion 211. Furthermore, the rear end portion 212 has an enlarged diameter part 213 that is formed to have a largest diameter in the application part 21.

In this embodiment, the retainer part 22 is formed into a circular truncated cone shape decreasing in diameter from the rear end toward the tip end. The retainer part 22 has a through hole 221 extending along the axial direction. The through hole 221 has an inner diameter of such a dimension as not to allow the enlarged part 213 of the application part 21 to pass therethrough, while allowing the non-bundled part of the application part 21 to pass therethrough.

In this embodiment, the pen tip part 2 is fixed to the cylindrical part 32 in the hollow part 23. The hollow part 23 is formed to be fitted onto a tip end portion 321 of the cylindrical part 32. The hollow part 23 and the cylindrical part 32 are configured to be able to come into liquid-tight engagement with each other. In this embodiment, internal threads are formed on the inner peripheral surface of a rear end portion 232 of the hollow part 23, and external thread capable of coming into threaded engagement with the internal threads are formed on the outer peripheral surface of the tip end portion 321 of the cylindrical part 32. Thereby, the hollow part 23 and the cylindrical part 32 are configured to be capable of coming into threaded engagement with each other.

Further, a sealing member 4 having an annular shape is provided inside the hollow part 23. The sealing member 4 is disposed to be sandwiched between a rear end portion 222 of the retainer part 22 and a tip end portion 321 of the cylindrical part 32 in the state where the pen tip part 2 is fixed to the cylindrical part 32. The sealing member has an opening 41 allowing ink to pass therethrough. The inner diameter of the opening 41 is formed to be larger than the inner diameter of the flow channel in the application part 21 and smaller than the outer diameter of the enlarged diameter part 213 of the application part 21. The sealing member 4 is disposed to allow the opening 41 to be in communication with the flow channel in the application part 21. The sealing member 4 makes it easy to guide ink flowing out from the coating liquid storage section 31 into the flow channel via the opening 41, and consequently makes it easy to supply ink to the pen tip part 2.

The coating liquid storage section 31 has a bottomed cylindrical shape having a tip end portion 311 that is opened and a rear end portion 312 that is closed. The coating liquid storage section 31 has an internal space S for filling ink. The coating liquid storage section 31 includes a mixing member 314 having a ball shape and provided to accelerate the process of mixing of ink. The mixing member 314 has a smaller diameter than the inner diameter of the coating liquid storage section 31, to thereby move in the internal space S in the axial direction by shaking of the writing instrument 1 in the axial direction. The mixing member 314 generally has a larger density than the density of ink. Thus, the mixing member 314 precipitates in ink.

Ink can be water-based ink or can be oil-based ink.

The cylindrical part 32 is formed into a cylindrical shape with the tip end portion 321 and a rear end portion 322 both being opened. The cylindrical part 32 is formed to be capable of housing the coating liquid storage section 31. As shown in FIG. 1, the inner peripheral surface of the cylindrical part 32 and the outer peripheral surface of the coating liquid storage section 31 together form a gap G1 therebetween. Thereby, the coating liquid storage section 31 is movable inside the cylindrical part along the axial direction. Also, the coating liquid storage section 31 can be relatively movable to the pen tip part 2 in the axial direction. The coating liquid storage section 31 can move inside the cylindrical part 32 so that part of the inner peripheral surface of the cylindrical part 32 and part of the outer peripheral surface of the coating liquid storage section 31 come into sliding contact with each other.

The cylindrical part 32 is formed to expose the rear end portion 312 of the coating liquid storage section 31 to the outside. With this configuration, the user can easily press the rear end portion 312 of the coating liquid storage section 31 (preferably, a rear end surface of the coating liquid storage section 31) by a thumb or the like and consequently can easily move the coating liquid storage section 31 toward the tip end side.

The writing instrument 1 further includes a valve mechanism 5 disposed at the tip end portion 311 of the coating liquid storage section 31, and a pressing member 6 that is an operation member 6 configured to press the valve mechanism 5 to thereby open the valve mechanism 5. The pressing member 6 of this embodiment is fixed to the tip end portion 321 of the cylindrical part 32. In this embodiment, the pressing member 6 is directly fixed to the cylindrical part 32.

The writing instrument 1 is configured to be capable of coming into close state and open state. In close state, the pressing member 6 does not press the valve mechanism 5 to bring the valve mechanism 5 into open state so that the valve mechanism 5 is in close state. In open state, the coating liquid storage section 31 is moved toward the tip end side so that the pressing member 6 presses the valve mechanism 5 so that the valve mechanism 5 is in open state. This configuration allows the valve mechanism 5 to be relatively movable to the pressing member 6 in the axial direction. In close state, a portion of the pressing member 6 that presses the valve mechanism 5 (specifically, protrusion 63 to be described later) can be in contact with the valve mechanism 5 or can be away from the valve mechanism 5. In other words, allowance can be provided between the valve mechanism 5 and the portion of the pressing member 6 that presses the valve mechanism 5, or no such allowance can be provided therebetween.

The writing instrument 1 includes a cylindrical elastic member 7 that connects the valve mechanism 5 with the pressing member 6.

Figure 3:
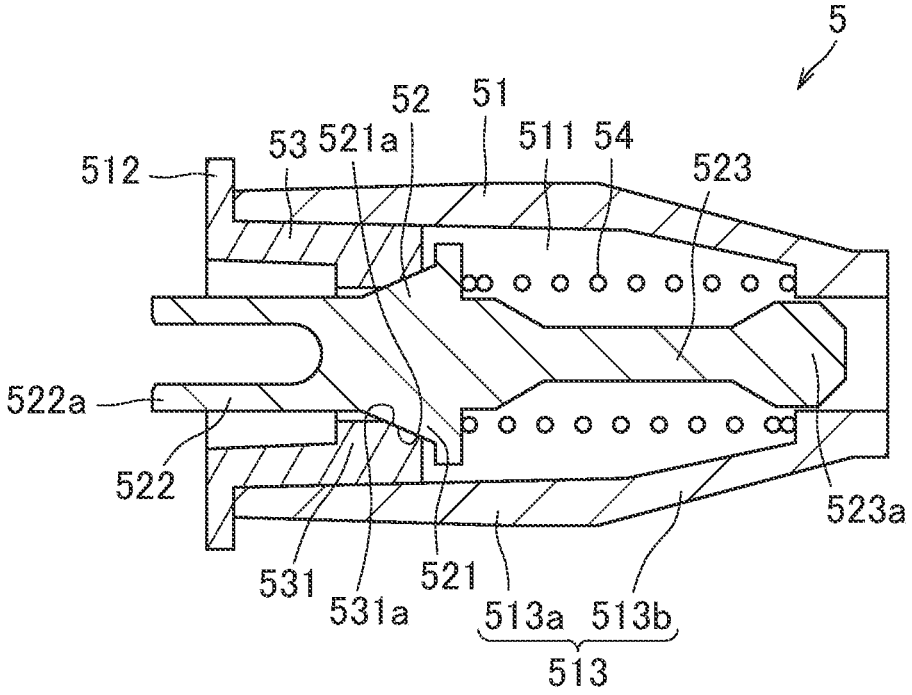
FIG. 3 shows an internal structure of a valve mechanism provided in the writing instrument of FIG. 1.
Figure 4:
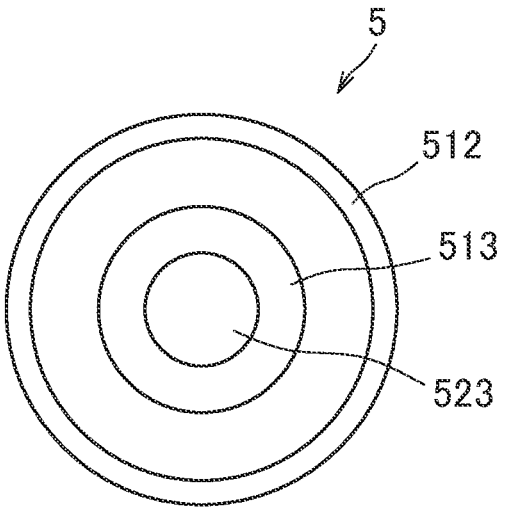
FIG. 4 is a view showing the valve mechanism provided in the writing instrument of FIG. 1 as viewed from a rear end side in an axial direction.

As shown in FIG. 3 and FIG. 4, the valve mechanism 5 of this embodiment includes a valve main body 51 inside of which a flow channel 511 extending in the axial direction is formed, a valve body 52 that is movable in the flow channel 511 along the axial direction, a valve seat 53 with which the valve body 52 is in contact so that the flow channel 511 can be closed, and a spring member 54 that biases the valve body 52 toward the valve seat 53.

The valve main body 51 is formed into a cylindrical shape extending along the axial direction so as to be capable of housing the valve body 52 and the valve seat 53. The valve main body 51 further includes a locking part 512 having an annular shape for restricting the valve main body 51 from entirely entering the coating liquid storage section 31. The valve main body 51 further includes an insertion part 513 that is formed to extend from the locking part 512 toward the rear end side and is disposed inside the coating liquid storage section 31.

The outer diameter of the locking part 512 is formed to be larger than the inner diameter of the tip end portion 311 of the coating liquid storage section 31.

The locking part 512 of this embodiment functions as a first elastic member connecting part 512 for connection of a rear end portion 72 of the cylindrical elastic member 7. The outer diameter of the locking part 512 is formed to be smaller than the outer diameter of the tip end portion 311 of the coating liquid storage section 31. With this configuration, the connection portion between the locking part 512 and the coating liquid storage section 31 gradually increases in diameter from the locking part 512 toward the tip end portion 311 of the coating liquid storage section 31.

The insertion part 513 has a first extension part 513*a* that is formed to extend from the locking part 512 toward the rear end side and is formed to be in contact with the inner peripheral surface of the coating liquid storage section 31 along the circumferential direction. The insertion part 513 also has a second extension part 513*b* that is formed to extend from the first extension part 513*a* further toward the rear end side and is formed to decrease in diameter toward the rear end side. The second extension part 513*b* is disposed so that its outer peripheral surface is out of contact with the inner peripheral surface of the coating liquid storage section 31.

The valve body 52 includes a contact part 521 that comes into contact with the valve seat 53, a first valve rod part 522 that extends from the contact part 521 toward the tip end side, and a second valve rod part 523 that extends from the contact part 521 toward the rear end side.

The contact part 521 is disposed to come into contact with the valve seat 53 from the rear end side toward the tip end side (by moving from the rear end side toward the tip end side in the axial direction). The contact part 521 is formed into a circular truncated cone shape decreasing in diameter from the rear end side toward the tip end side and has a contact surface 521*a* that comes into contact with the valve seat 53 along the radial direction.

The first valve rod part 522 has a tip end portion 522*a* formed to protrude from the valve main body 51 in the state where the contact part 521 is in contact with the valve seat 53. The first valve rod part 522 is formed into a cylindrical shape.

The second valve rod part 523 has a rear end portion 523*a* formed to protrude from the valve main body 51 in the state where the contact part 521 is away from the valve seat 53 while being close to the rear end side. The mixing member 314, which may be able to close the flow channel 511 of the valve main body 51 from the rear end side, can be separated from the valve main body 51 by the second valve rod part 523.

The valve seat 53 has a contacted part 531 with which the valve body 52 comes into contact. The contacted part 531 has a contacted surface 531*a* having a shape corresponding to the contact surface 521*a* of the valve body 52. In other words, the contacted part 531 is formed to extend in the axial direction and formed into a circular truncated cone shape with the inner diameter increasing from the tip end side toward the rear end side.

The spring member 54 has a tip end portion in contact with the valve body 52 and a rear end portion in contact with the insertion part 513 of the valve main body 51. The spring member 54 disposed in this manner comes into contracted state in which the spring member 54 is contracted in the axial direction in association with the movement of the coating liquid storage section 31 toward the tip end side. Specifically, the valve body 52 is pressed by the pressing member 6 in association with the movement of the coating liquid storage section 31 toward the tip end side, thereby the spring member 54 comes into contracted state in which the spring member 54 is contracted by receiving a pressure of the valve body 52 moving toward the rear end side. Further, the spring member 54 comes into expanded state in which the spring member 54 biases the valve body 52 toward the tip end side so as to cause the valve body 52 to be in contact with the valve seat 53 as the valve body 52 is released from the pressure by the pressing member 6 in association with the movement of the coating liquid storage section 31 toward the rear end side.

More specifically, the spring member 54 of this embodiment is a coil spring.

Figure 5:
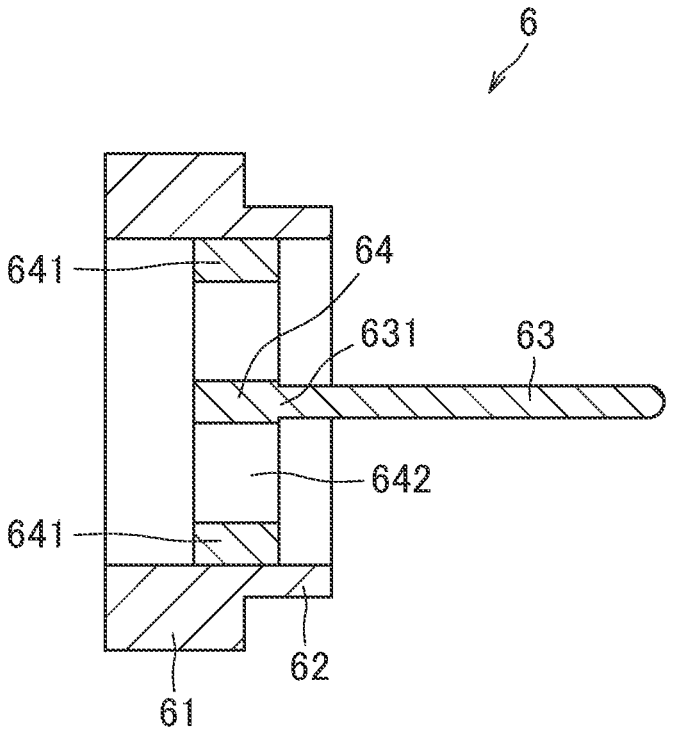
FIG. 5 is a cross section view of a pressing member of the writing instrument of FIG. 1.
Figure 6:
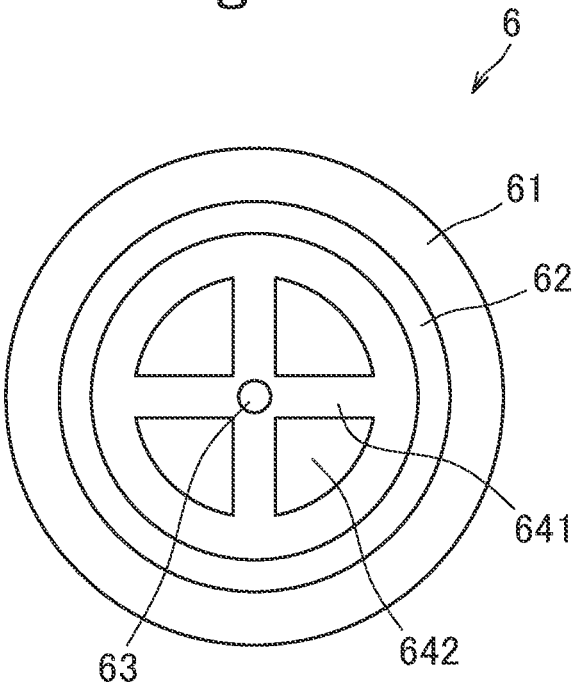
FIG. 6 is a view showing the pressing member of the writing instrument of FIG. 1 as viewed from the rear end side in the axial direction.
Figure 7:
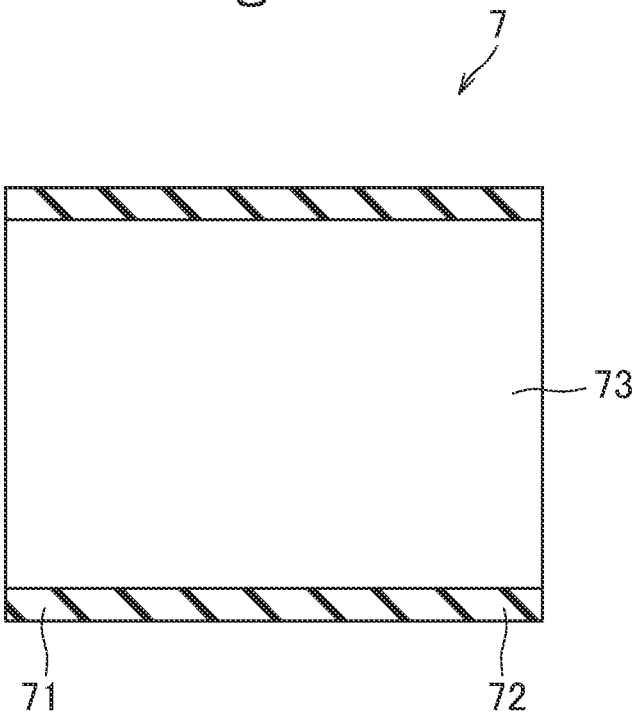
FIG. 7 is a cross section view of a cylindrical elastic member of the writing instrument of FIG. 1.
Figure 8:
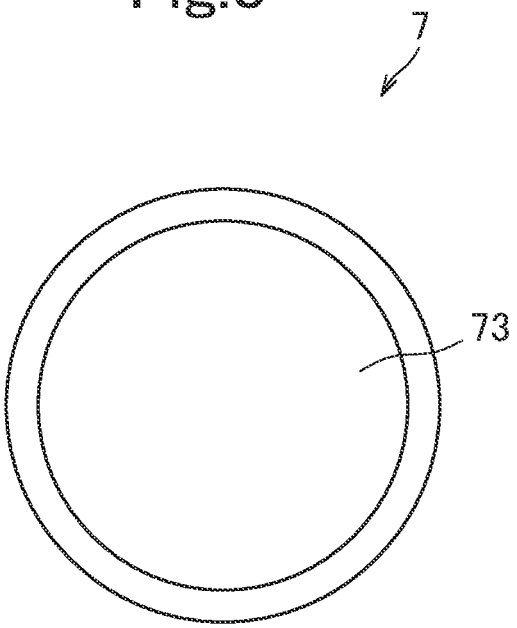
FIG. 8 is a view of the cylindrical elastic member of the writing instrument of FIG. 1 as viewed from one side in the axial direction.

As shown in FIG. 5 and FIG. 6, the pressing member 6 of this embodiment includes a locking part 61 having a cylindrical shape for restricting the locking part 61 from entirely entering the cylindrical part 32, a second elastic member connecting part 62 having an annular shape formed to extend from the locking part 61 toward the rear end side and serving as a part for connection with a tip end portion 71 of the cylindrical elastic member 7, a protrusion 63 having a rod shape formed to protrude toward the rear end side of the second elastic member connection part 62 and directly press the valve mechanism 5, and a support part 64 for providing support to the protrusion 63 through the locking part 61 or the second elastic member connection part 62.

The pressing member 6 is disposed to allow the locking part 61 to come into contact with the tip end portion 321 of the cylindrical part 32.

The outer diameter of the second elastic member connection part 62 is formed to be smaller than the inner dimeter of the tip end portion 321 of the cylindrical part 32. With this configuration, the outer peripheral surface of the second elastic member connection part 62 and the inner peripheral surface of the tip end portion 321 of the cylindrical part 32 together form a gap G2 therebetween to dispose the cylindrical elastic member 7 therein, as shown in FIG. 1.

The protrusion 63 is formed to be insertable into the first valve rod part 522 of the valve body 52. Thereby, the protrusion 63 comes into contact with the valve body 52 so as to be guided by the first valve rod part 522. The protrusion 63 of this embodiment is disposed inside the first valve rod part 522 in both of close state and open state of the valve mechanism 5. The protrusion 63 can be disposed outside the first valve rod part 522 when the valve mechanism 5 is in close state.

The support part 64 includes at least one or more of support pieces 641 formed to extend from a base end 631 of the protrusion 63 to the inner peripheral surface of the locking part 61 or the second elastic member connection part 62. The support part 64 is formed to have a flow channel 642 of ink. The support part 64 of this embodiment is formed into a cross shape having four support pieces 641 radially extending in four directions respectively from the base end 631 of the protrusion 63. Four flow channels 642 are formed between each adjacent support pieces 641.

As shown in FIG. 1, FIG. 2, FIG. 7, and FIG. 8, the cylindrical elastic member 7 connects the valve mechanism 5 with the pressing member 6 so as to allow a tip end portion 71 to cover the second elastic member connection part 62 in the pressing member 6, and allow a rear end portion 72 to cover the first elastic member connecting part 512 that is the locking part 512 in the valve mechanism 5. The cylindrical elastic member 7 has a flow channel 73 that allows ink flowing out from the valve mechanism 5 to be moved from the valve mechanism 5 to the pressing member 6 when the valve mechanism 5 is brought into open state.

In the cylindrical elastic member 7 of this embodiment, the rear end portion 72 extends over the first elastic member connecting part 512 of the valve mechanism 5 to cover a part of the tip end portion 311 of the coating liquid storage section 31. That is, the cylindrical elastic member 7 reinforces the fixing of the valve mechanism 5 to the coating liquid storage section 31. The cylindrical elastic member 7 also covers the portion connecting the valve mechanism 5 with the coating liquid storage section 31 to prevent leakage of the coating liquid.

Figure 9:
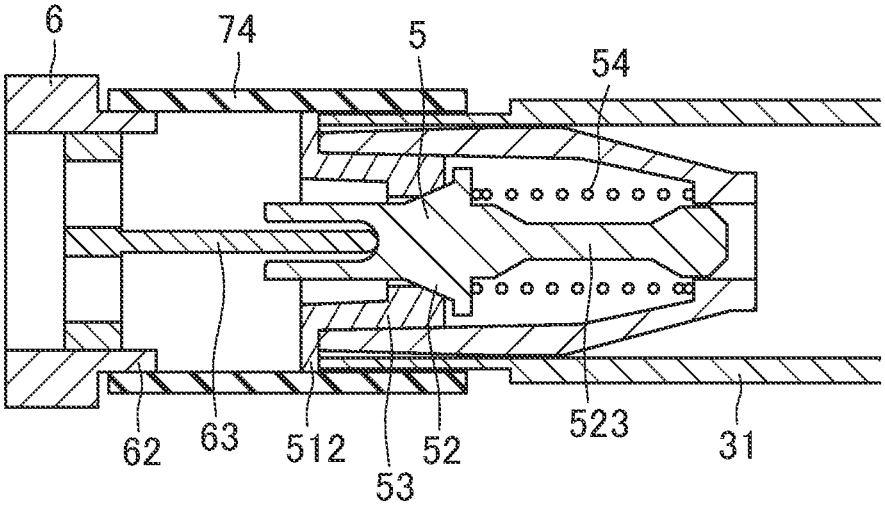
FIG. 9 shows a relationship between the valve mechanism, the pressing member, and the cylindrical elastic member when the valve mechanism is in close state.
Figure 10:
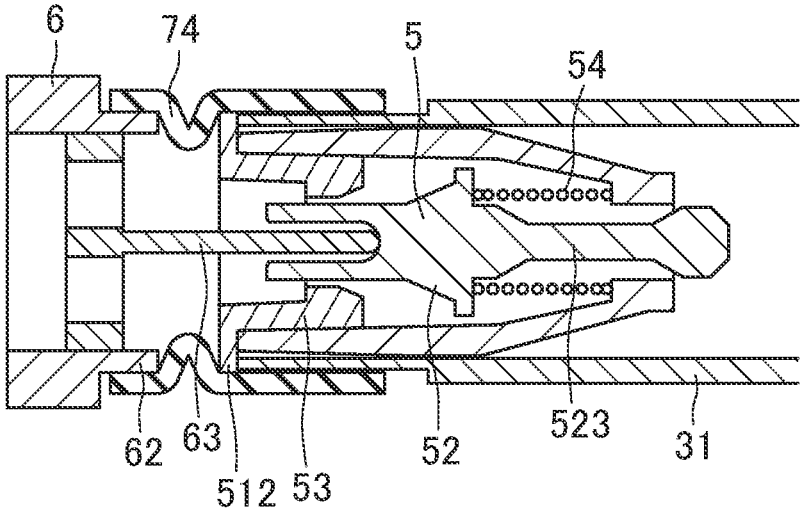
FIG. 10 shows a relationship between the valve mechanism, the pressing member, and the cylindrical elastic member when the valve mechanism is in open state.

As shown in FIG. 9 and FIG. 10, the cylindrical elastic member 7 that connects the valve mechanism 5 with the pressing member 6 forms, between the tip end portion 71 and the rear end portion 72, an expansion-contraction part 74 that expands and contract in the axial direction. As shown in FIG. 10, the cylindrical elastic member 7 comes into contracted state in which the cylindrical elastic member 7 is contracted in the axial direction in association with the movement of the coating liquid storage section 31 toward the tip end side. Specifically, the cylindrical elastic member 7 receives the pressure in the axial direction from each of the valve mechanism 5 and the pressing member 6 as the valve mechanism 5 approaches the pressing member 6 upon the movement of the coating liquid storage section 31 toward the tip end side, to thereby cause the expansion-contraction part 74 to come into contracted state in which the expansion-contraction part 74 is contracted in the axial direction. Further, as shown in FIG. 9, the cylindrical elastic member 7 receives a tensile force in the axial direction from each of the valve mechanism 5 and the pressing member 6 as the valve mechanism 5 moves away from the pressing member 6 upon the movement of the coating liquid storage section 31 toward the rear end side, to thereby cause the expansion-contraction part 74 to comes into (from contracted state to) expanded state in which the expansion-contraction part 74 is expanded in the axial direction (FIG. 9).

Further, the cylindrical elastic member 7 of this embodiment is configured to allow the expansion-contraction part 74 to come into the state of decreasing in diameter or warping in the radially inward direction, while the expansion-contraction part 74 is in contracted state, as shown in FIG. 10. The cylindrical elastic member 7 can be configured to allow the expansion-contraction part 74 to come into the state of increasing in diameter in the radially outward direction, while the expansion-contraction part 74 is in contracted state.

The cylindrical elastic member 7 of this embodiment is configured to allow the inner peripheral surface of the expansion-contraction part 74 to have a cylindrical shape to be substantially straight along the axial direction, while the expansion-contraction part 74 is in expanded state.

Examples of the material for forming the cylindrical elastic member 7 include a thermos plastic elastomer material.

As described above, the writing instrument 1 of this embodiment includes: a pen tip part 2 for applying a coating liquid; a coating liquid storage section 31 for storage of the coating liquid; a cylindrical part 32 having a cylindrical shape so as to cover the coating liquid storage section 31, and fixed to the pen tip part 2; a valve mechanism 5 disposed at a tip end portion 311 of the coating liquid storage section 31; an operation member 6 fixed to the pen tip part 2 and configured to open the valve mechanism 5 and allow the coating liquid flowing out from the coating liquid storage section 31 to flow toward a pen tip side via the valve mechanism 5; and a cylindrical elastic member 7 being capable of expanding and contracting in an axial direction, and connecting the valve mechanism 5 with the operation member 6 to define a flow channel of the coating liquid between the valve mechanism 5 and the operation member 6; in which the coating liquid storage section 31 is relatively movable to the pen tip part 2 in the axial direction, and the operation member 6 is configured to open the valve mechanism 5 in association with the relative movement of the coating liquid storage section 31 to the pen tip part 2.

According to the writing instrument 1 with the above configuration, the cylindrical elastic member 7 connecting the valve mechanism 5 with the operation member 6 can prevent leakage of the coating liquid from therebetween. Further, the coating liquid storage section 31 is relatively movable to the pen tip part 2 in the axial direction, and the operation member 6 causes the valve mechanism 5 to be opened in association with the relative movement of the coating liquid storage section 31. Thereby, it is possible to supply the coating liquid to the pen tip part 2, while discharging the coating liquid from the coating liquid storage section 31 via the valve mechanism 5 and the flow channel 73 of the cylindrical elastic member 7. Furthermore, unintentional flowing out of the coating liquid from the tip end portion 311 toward the pen tip side can be suppressed since the tip end portion 311 of the coating liquid storage section 31 is closed by the valve mechanism 5 when the valve mechanism 5 is closed. Therefore, according to the above configuration, the user can relatively precisely control the supply amount of the coating liquid to the pen tip part 1 by operating the opening and closing of the valve mechanism 5 by moving the coating liquid storage section 31 toward the pen tip part 2.

In the writing instrument 1 of this embodiment, the operation member 6 is configured to bring the valve mechanism 5 into open state by pressing the valve mechanism 5.

According to the writing instrument 1 with the above configuration, the operation member 6 presses the valve mechanism 5 to bring the valve mechanism 5 into open state, which can achieve a relatively simple structure.

In the writing instrument 1 of this embodiment, an end portion on one side (i.e., rear end portion 72) of the cylindrical elastic member 7 covers the tip end portion 311 of the coating liquid storage section 31, while covering the valve mechanism 5.

According to the writing instrument 1 with the above configuration, an end portion on one side (i.e., rear end portion 72) of the cylindrical elastic member 7 covers both of the valve mechanism 5 and the tip end portion 311 of the coating liquid storage section 31, which makes it possible to prevent leakage of the coating liquid from a gap that may occur between the valve mechanism 5 and the coating liquid storage section 31.

In addition, according to the writing instrument 1 of this embodiment, since the coating liquid storage section 31 pressed toward the tip end side causes the expansion-contraction part 74 of the cylindrical elastic member 7 to come into contracted state, the coating liquid storage section 31 is movable together with the valve mechanism 5 toward the pressing member 6 by the distance by which the expansion-contraction part 74 is contracted. Then, the contact part 521 of the valve mechanism 5 is pressed by the protrusion 63 of the pressing member 6 to allow the valve mechanism 5 to come into open state. In association with this, ink discharged from the coating liquid storage section 31 is moved to the tip end side via the flow channel 511 of the valve mechanism 5, the flow channel 73 of the cylindrical elastic member 7, and the flow channels 642 of the pressing member 6, to be supplied to the pen tip part 2.

According to the writing instrument 1 of this embodiment, the valve mechanism 5 is in close state when the coating liquid storage section 31 is not pressed. Thus, even in the case where the coating liquid having a low viscosity or a low surface tension is used, the coating liquid does not flow out of the pen tip and it is possible to precisely control the supply amount of the coating liquid as desired by the user.

According to the writing instrument 1 of this embodiment, it is possible to prevent the ink leakage. Thus, it is unlikely to cause the ink stain so that the user can use it without care.

According to the writing instrument 1 of this embodiment, the portion connecting the coating liquid storage section 31 with the first elastic member connecting part 512 that is the locking part 512 has a diameter stepwisely increasing from the first elastic member connecting part 512 toward the tip end portion 311 of the coating liquid storage section 31, which makes it possible to easily attach the cylindrical elastic member 7 to an area from the first elastic member connecting part 512 to the tip end portion 311.

According to the writing instrument 1 of this embodiment, the cylindrical elastic member 7 covers an area from the first elastic member connecting part 512 to the tip end portion 311 of the coating liquid storage section 31, which can prevent the ink leakage from a gap that may occur between the valve mechanism 5 and the coating liquid storage section 31. Furthermore, unintentional detachment of the valve mechanism 5 from the coating liquid storage section 31 can be also prevented.

According to the writing instrument 1 of this embodiment, the expansion-contraction part 74 of the cylindrical elastic member 7 is configured to have the inner peripheral surface substantially straight along the axial direction when it is in expanded state, and thus allows ink to easily flow from the cylindrical elastic member 7 to the pressing member 6. Thereby, ink is hardly left inside the cylindrical elastic member 7 to thereby be able to suppress adhesion of ink to the inner peripheral surface of the cylindrical elastic member 7. Accordingly, smooth supply of ink to the pen tip part 2 can be maintained for a long term. This is suitable to the case where the writing instrument 1 is refillable with ink.

According to the writing instrument 1 of this embodiment, the pressing member 6 is directly fixed to the cylindrical part 32. Thus, when the pen tip part 2 is detached from the cylindrical part 32, the pressing member 6 comes into the state of being exposed on the tip end side of the cylindrical part 32. When the rear end portion of the coating liquid storage section 31 is pressed in this state, the valve mechanism 5 is opened by the pressing member 6 fixed to the cylindrical part 32. Thereby, the coating liquid storage section 31 can be refilled with ink via (the flow channel 642 of) the pressing member 6. Since the pressing member 6 and the valve mechanism 5 are connected with each other by the cylindrical elastic member 7 also at the time of refilling ink, the ink leakage can be suppressed.

Although the writing instrument according to this embodiment is as described above, the present invention is not limited to the aforementioned embodiment and the design may be appropriately changed within the scope where the present invention is intended. Also, the functional effect of the present invention is not limited to the aforementioned embodiment. That is, the embodiments disclosed herein should be assumed as not limitations but exemplifications in all aspects. The scope of the present invention is described not by the above description but by the claims. Further, the scope of the present invention is intended to include the scope equivalent to the claims and all the changes in the claims.

For example, in the above embodiment, the writing instrument filled with ink as the coating liquid was described as an example, but the present invention is not limited thereto, and the writing instrument of the present invention can be filled with water, India ink, or the like as the coating liquid.

Further, in the above embodiment, the present invention was described by taking, for example, the form in which the valve mechanism 5 is relatively movable to the pressing member 6 in the axial direction, but the present invention is not limited thereto, and the pressing member 6 can be relatively movable to the valve mechanism 5 in the axial direction.

Further, the pressing member 6 can be indirectly fixed to the cylindrical part 32 to thereby be fixed to the cylindrical part 32. In other words, the pressing member 6 can be indirectly fixed to the cylindrical part 32 by being fixed to a member or part other than the cylindrical part 32. For example, the pressing member 6 can be fixed to the inside of the hollow part 23 of the pen tip part 2.

Further, the cylindrical elastic member 7 can be formed into an accordion shape. Thereby, the expansion-contraction part 74 can easily expand and contract in the axial direction.

What is claimed is:

1. A writing instrument comprising:

a pen tip part for applying a coating liquid;

a coating liquid storage section for storage of the coating liquid;

a cylindrical part having a cylindrical shape so as to cover the coating liquid storage section, and fixed to the pen tip part;

a valve mechanism disposed at a tip end portion of the coating liquid storage section;

an operation member fixed to the pen tip part and configured to open the valve mechanism and allow the coating liquid flowing out from the coating liquid storage section to flow toward a pen tip side via the valve mechanism; and a cylindrical elastic member being capable of expanding and contracting in an axial direction, and connecting the valve mechanism with the operation member to define a flow channel of the coating liquid between the valve mechanism and the operation member; wherein the coating liquid storage section is relatively movable to the pen tip part in the axial direction, and the operation member is configured to open the valve mechanism in association with the relative movement of the coating liquid storage section to the pen tip part.

2. The writing instrument according to claim 1, wherein the operation member is configured to bring the valve mechanism into open state by pressing the valve mechanism.

3. The writing instrument according to claim 2, wherein the cylindrical elastic member covers the tip end portion of the coating liquid storage section, while covering the valve mechanism.

4. The writing instrument according to claim 1, wherein the cylindrical elastic member covers the tip end portion of the coating liquid storage section, while covering the valve mechanism.

* * * * *